US008166946B2

(12) United States Patent
Sekiguchi et al.

(10) Patent No.: US 8,166,946 B2
(45) Date of Patent: May 1, 2012

(54) DIESEL ENGINE START-UP ASSISTING DEVICE

(75) Inventors: Keiichi Sekiguchi, Niiza (JP); Shigeo Yoshizaki, Niiza (JP); Hideki Asuke, Niiza (JP)

(73) Assignees: Sanken Electric Co., Ltd., Niiza-shi (JP); Denso Corporation, Kariya (JP)

( * ) Notice: Subject to any disclaimer, the term of this patent is extended or adjusted under 35 U.S.C. 154(b) by 305 days.

(21) Appl. No.: 12/690,328

(22) Filed: Jan. 20, 2010

(65) Prior Publication Data

US 2010/0186704 A1 Jul. 29, 2010

(30) Foreign Application Priority Data

Jan. 23, 2009 (JP) ..... P2009-013554

(51) Int. Cl.
*F02N 11/08* (2006.01)
*F02N 11/10* (2006.01)

(52) U.S. Cl. ..... 123/179.3; 123/179.6

(58) Field of Classification Search ..... 123/179.3, 123/179.6, 179.28, 179.21, 145 A; 701/113
See application file for complete search history.

(56) References Cited

U.S. PATENT DOCUMENTS 4,106,465 A * 8/1978 Bernhardt et al. ..... 123/179.21
4,493,298 A * 1/1985 Kawamura ..... 123/145 A
2008/0208440 A1* 8/2008 Hiramatsu ..... 701/113

FOREIGN PATENT DOCUMENTS

JP 3596415 9/2004

* cited by examiner

*Primary Examiner* — Mahmoud Gimie
(74) *Attorney, Agent, or Firm* — Oblon, Spivak, McClelland, Maier & Neustadt, L.L.P.

(57) ABSTRACT

A diesel engine start-up assisting device includes a plurality of first-and-second switching elements 11*a* to 11*d* between a common direct-current power source 1 and a plurality of electrical load 3*a* to 3*d*, a plurality of start-up assisting main parts 10*a* to 10*d* and an input-and-output unit 7. The diesel engine start-up assisting device is constructed so as to enable start-up of a diesel engine when power distribution is applied to at least one of the electrical loads 3*a* to 3*d*. In arrangement, the first-and-second switching elements 11*a* to 11*d*, the start-up assisting main parts 10*a* to 10*d* and the input-and-output unit 7 are integrated into one package having a lead frame. Defining the first-and-second switching element as a pair of switching elements, the first-and-second switching elements 11*a* to 11*d* are arranged in parallel with each other on the lead frame, and the lead frame has a notch part formed between two pairs of switching elements adjoined to each other.

5 Claims, 4 Drawing Sheets

DIESEL ENGINE START-UP ASSISTING DEVICE

BACKGROUND OF THE INVENTION

1. Field of the Invention

The present invention relates to a diesel engine start-up assisting device that starts up a diesel engine by supplying an electric load, which will be referred to as "load" hereinafter, with current to heat up the load.

2. Description of the Related Art

In the diesel engine start-up assisting device, conventionally, there are two types of devices: glow system and intake heater system. Generally speaking, the glow system is used in a pre-combustion chamber type diesel engine, while the intake heater system is used in a direct-injection type diesel engine having a large engine displacement. The glow system has a feature of superior flash heating capability and therefore, the same system is adopted for passenger automobiles etc. universally.

In a conventional glow system, for example, there is a relay system shown in FIG. 1. In this relay system, as shown in the figure, an engine control unit (ECU) 107 detects a water temperature in a not-shown engine system. Then, in response to the detected water temperature, the ECU 107 allows a battery 101 to apply electrical current to a glow plug 105 through a fuse 102, a switch 103 and a relay 104 in order to heat up the interior of a cylinder 106 of the diesel engine, thereby improving the start-up performance of the engine, particularly in winter.

In the relay system, however, it is impossible to perform system control through on/off switching actions due to the presence of various problems about the durability of relay contacts, their operational noise and the responsibility, and therefore it is difficult to adjust the temperature inside the cylinder of the diesel engine appropriately. Furthermore, since the relay system is provided with mechanical contacts, it has a problem of failure occurrence due to life duration of relays.

Meanwhile, there is known a load drive circuit which utilizes semiconductor switching elements as electrical components to drive injectors as fuel injection devices (see Japanese Patent No. 3596415). Thus, with the adoption of this load drive circuit in the glow system, it is possible to solve the above-mentioned problem.

In the field of load drive circuits, there is a load drive circuit having a function of detecting an overcurrent of the power distribution to the load. For instance, there is employed a current mirror circuit comprising a first switching element composed of an n-channel type power MOSFET (metal-oxide semiconductor field-effect transistors) etc. which energizes or cuts off the power distribution to a load and a second switching element composed of an n-channel type power MOSFET etc. which allows a passage of current smaller than that of the first switching element, in order to detect an overcurrent.

In the current mirror circuit, it is noted that the first switching element and the second switching element are driven by the same drive command signal. Furthermore, the second switching element is constructed so as to permit the passage of current proportional to the first switching element (e.g. $1^{st}$ switching element: $2^{nd}$ switching element=10000: 1).

In the above-constructed load drive circuit having the function of detecting overcurrent, for example, if an abnormality, such as grounded short-circuit, occurs in a load thereby causing the passage of overcurrent through the first switching element, then a current proportional to the overcurrent flows through the second switching element. Therefore, the load drive circuit is provided with an overcurrent protective unit that detects an overcurrent flowing through the first switching element when the current flowing through the second switching element exceeds a current value corresponding to the overcurrent of the first switching element, and that inactivates the first switching element in view of protecting it.

In general, the conventional diesel engine start-up assisting device includes a plurality of loads, a plurality of first switching elements and a plurality of second switching elements, both of which correspond to the plurality of loads, and a plurality of protective units that protect the plurality of first switching elements. With this constitution, the diesel engine start-up assisting device is constructed so that, when power is distributed to at least one of the multiple loads, heat generation of the at least one load distributed with power allows a diesel engine to be started up.

Assume here that a combination of the first switching element with the second switching element is defined as a power element. In case that a plurality of power elements comprising a plurality of first switching elements and a plurality of second switching elements in combination are housed into one package IC (integrated circuit), built-in integrated circuits (ICs) in the power elements generate heat with power consumption. As an integrated circuit (IC) composed of semiconductors is hard to be normally operated in high-temperature environment, an allowable power consumption (amount) in consideration of the heat generation of IC is predetermined so as to prevent a false operation of IC caused by the heat generation with power consumption. In general, the allowable power consumption (amount) is determined on a basis of the thermal resistance of an integrated circuit (IC). Note that "thermal resistance" represents the percentage of a temperature elevation to the power consumption.

In such an integrated circuit whose thermal resistance is small, there has been attempted to unify frames for mounting multiple pairs of built-in power elements thereon for the purpose of increasing the allowable power consumption (amount). With this unification of frame, it is expected to enlarge a heat radiation area and reduce the thermal resistance as possible.

SUMMARY OF THE INVENTION

However, it should be noted that there exists a phenomenon of homogenization in temperature gradient of the interior of an integrated circuit (IC) chip. That is, despite a difference in the ratio of temperature elevation to power consumption among a plurality of power elements built in the integrated circuit, the temperature difference among the power elements is reduced since the heat generation of a frame for mounting the power element thereon is equalized, so that a certain power element is subjected to heat interference from the adjoining power element.

Suppose that, for instance, an abnormality such as short-circuit occurs in a certain load. Then, as the power element corresponding to this load having such an abnormality generates heat abnormally, another power element adjacent to the abnormally-heated power element is subjected to the same temperature environment as the abnormally-heated power element, in spite of its normal operating. Consequently, even if detecting the abnormality in a load and successively bringing an abnormal power element corresponding to the load into a stand, a normal power element adjacent to the abnormal power element might be turned off since an improper detection for heat generation is applied to the normal power element, so that the system performance becomes exacerbated.

Under the above-mentioned situation, an object of the present invention is to provide a diesel engine start-up assisting device which can restrain the influence of temperature interference among power elements in an integrated circuit having the power elements built therein when detecting electrical current flowing through the power elements and which can maintain the operations of the power elements except for a power element whose operation is stopped due to its heat generation.

In order to achieve the above objects, according to the present invention, there is provided a diesel engine start-up assisting device enabling start-up of a diesel engine when power distribution is applied to at least one of multiple electrical loads, comprising: a plurality of start-up assisting units each of which includes: a first switching element arranged in a first power distribution path extending from a direct-current power source to each of the electrical loads to energize or cut off the first power distribution path, based on a drive command signal inputted to a control terminal of the first switching element; a drive unit that outputs a drive command signal for driving the first switching element in response to a control command signal inputted from an external control unit to control power distribution to the electrical load; a second switching element arranged in a second power distribution path to supply a predetermined load with a current from the direct-current power source, the second switching element having its control terminal connected to the first switching element thereby passing an electric current proportional to the first switching element; a current sensing element for detecting an electrical current flowing through the second power distribution path; a current output unit that outputs an electrical current reduced in proportion to the electrical current flowing through the second power distribution path; an overcurrent protective unit that judges an occurrence of overcurrent when a current sensing signal detected by the current sensing unit exceeds a predetermined value and further outputs a power distribution stop signal to the drive unit, thereby bringing the power distribution through the first power distribution path into a stop to protect the first switching element; and an input-and-output unit that supplies the plurality of start-up assisting units with the control command signal and outputs a plurality of current output signals detected by the plurality of current output units to the external control unit thereby to allow the external control unit to generate the control command signal, wherein the plurality of start-up assisting units and the input-and-output unit are integrated into one package having a lead frame, defining the first switching element and the second switching element as a pair of switching elements, the plurality of first switching elements and the plurality of second switching elements are arranged in parallel with each other on the lead frame, and wherein the lead frame has a notch part formed between two pairs of switching elements adjoined to each other.

DETAILED DESCRIPTION OF THE PREFERRED EMBODIMENTS

There will be described embodiments of the present invention in detail below with reference to drawings.

Figure 1:
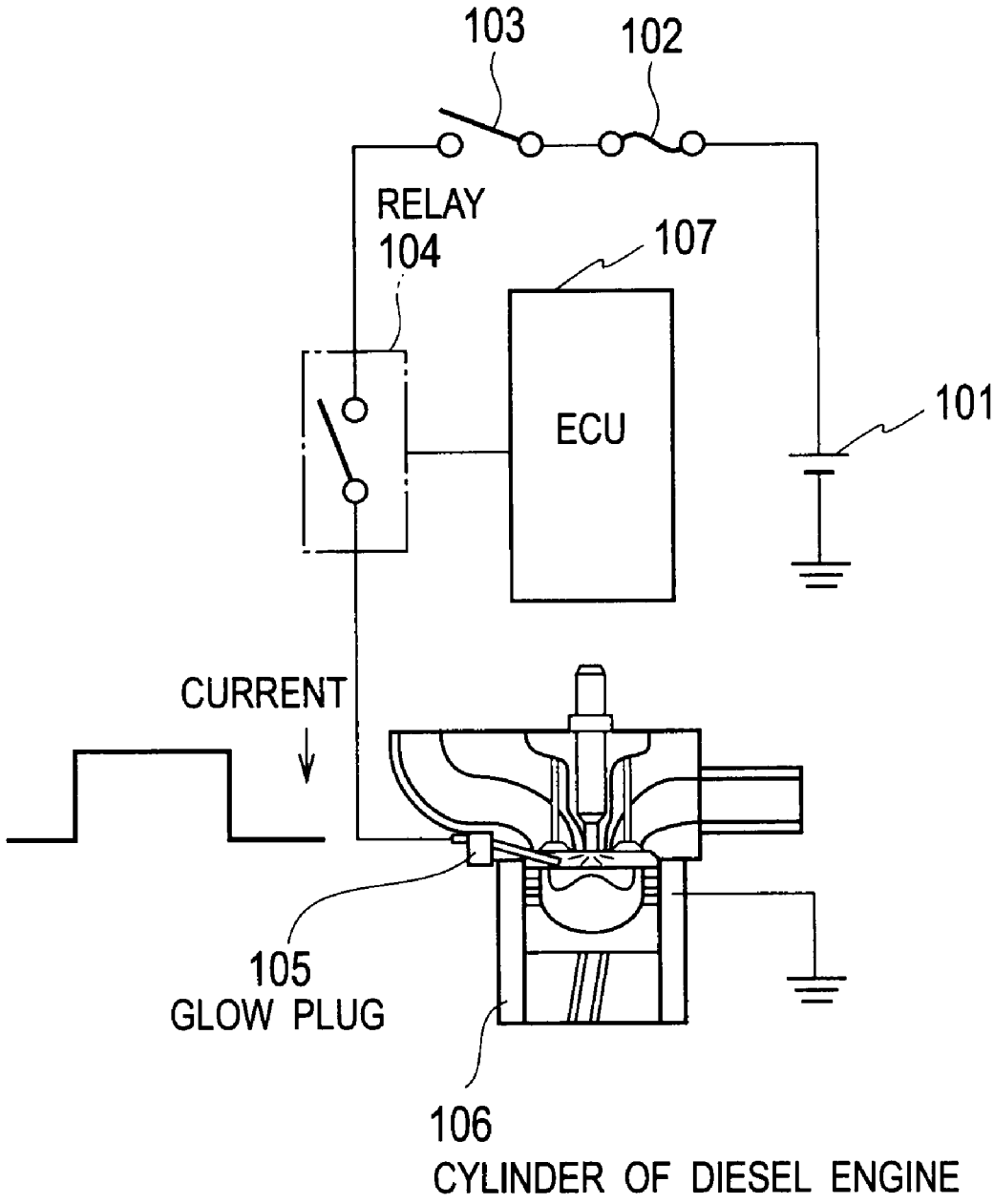
FIG. 1 is a schematic structural view of a diesel engine start-up assisting device using a conventional "relay" glow system.
Figure 2:
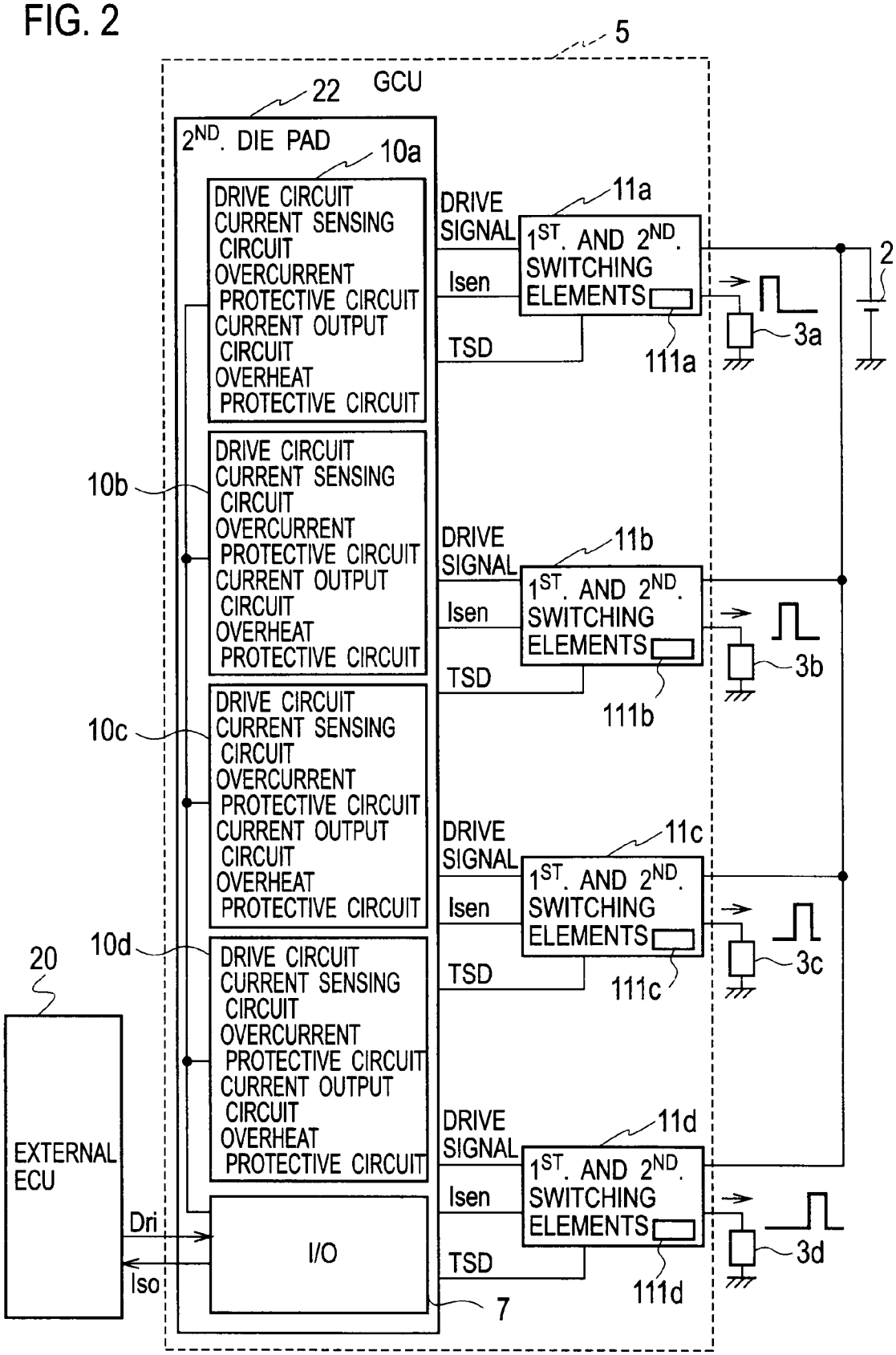
FIG. 2 is a structural view of a diesel engine start-up assisting device in accordance with an embodiment of the present invention.

FIG. 2 is a structural view of a diesel engine start-up assisting device in accordance with an embodiment of the present invention. This diesel engine start-up assisting device comprises a DC (direct current) power source 2, four first-and-second switching elements 11*a* to 11*d*, four loads 3*a* to 3*d* consisting of glow plugs respectively, four start-up assisting main parts 10*a* to 10*d* and an input/output (I/O) unit 7. In operation, the diesel engine start-up assisting device is adapted so as to start up a diesel engine when a power distribution to at least one of the loads 3*a* to 3*d* is performed.

The four first-and-second switching elements 11*a* to 11*d* comprises n-channel type power MOSFETs (metal-oxide semiconductor field-effect transistors) etc. which energize or cut off respective power distribution paths for the four loads 3*a* to 3*d*. In each first-and-second switching element, its drain is connected to a positive pole of the DC power source 2, while its source is connected to each of the loads 3*a* to 3*d*.

Figure 3:
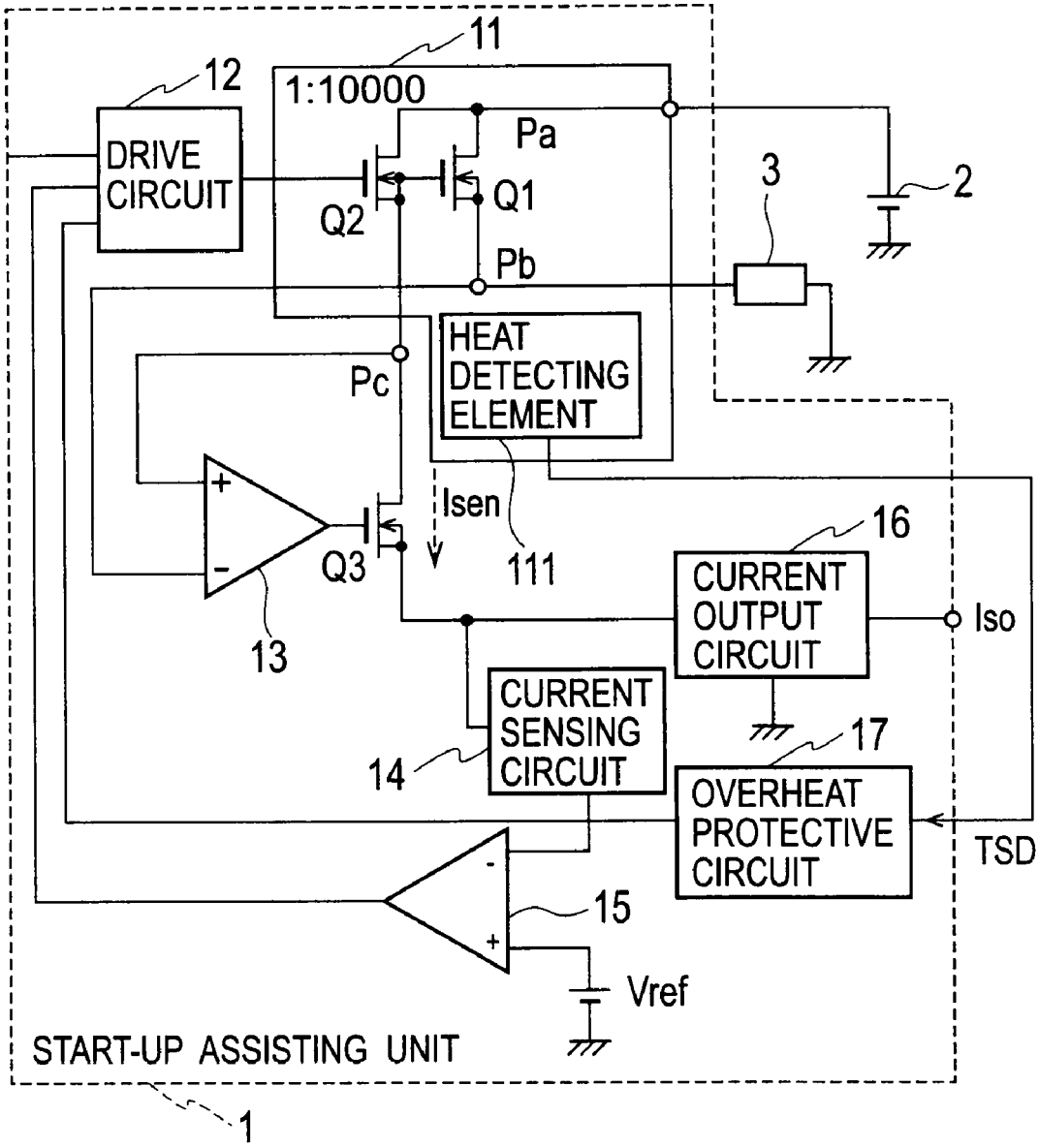
FIG. 3 is a circuit diagram of each start-up assisting unit of the diesel engine start-up assisting device of FIG. 2.

The four start-up assisting main parts 10*a* to 10*d* and the four first-and-second switching elements 11*a* to 11*d* constitute four start-up assisting units 1. FIG. 3 is a circuit diagram of each start-up assisting unit 1 constituting the diesel engine start-up assisting device shown in FIG. 2.

As shown in FIG. 3, the illustrated start-up assisting unit 1 comprises a first switching element Q1, a second switching element Q2, a drive circuit 12, an operational amplifier (Op-Amp) 13, a transistor Q3, a current sensing circuit 14, an overcurrent protective circuit 15, a current output circuit 16 and an overheat protective circuit 17. In operation, with a drive command signal from the drive circuit 12, the first switching element Q1 is switched on to supply the load with electric current, so that the load is heated to start up the diesel engine. As shown in FIG. 3, each of the four start-up assisting main parts 10*a* to 10*d* includes the drive circuit 12, the current sensing circuit 14, the overcurrent protective circuit 15, the current output circuit 16 and the overheat protective circuit 17.

The first switching element Q1 is arranged in a first power distribution path extending from the DC power source 2 to the load 3 to energize or cut off the first power distribution path, based on the drive command signal outputted from the drive circuit 12 and inputted to a gate of the first switching element Q1. On the other hand, the second switching element Q2 is arranged in a second power distribution path for supplying electrical current from the DC power source 2. Further, the second switching element Q2 has its gate connected to the gate of the first switching element Q1, and is controlled by the same drive command signal as that for the first switching element Q1. Thus, the second switching element Q2 is constructed so as to transmit electrical current proportional to that of the first switching element Q1 (e.g. $1^{st}$ switching element: $2^{nd}$ switching element=10000: 1). The transistor Q3 comprises an n-channel type power MOSFET (metal-oxide semiconductor field-effect transistor) or the like, and is connected to the second switching element Q2 in series.

The OP-Amp 13 has a non-inverting input terminal connected to the source of the second switching element Q2 and an inverting input terminal connected to the source of the first switching element Q1. In operation, the transistor Q3 is switched on so that the source potential of the first switching element Q1 becomes equal to the source potential of the second switching element Q2, allowing electrical current to pass through the second power distribution path.

The current sensing circuit 14 detects electrical current flowing through the transistor Q3 connected to the second switching element Q2 in the second power distribution path in series. The overcurrent protective circuit 15 comprises a comparator, and also includes a non-inverting input terminal connected to a reference voltage Vref and an inverting input terminal connected to the current sensing circuit 14. In operation, when a detection voltage proportional to the electrical current detected by the current sensing circuit 14 exceeds the above reference voltage Vref, the overcurrent protective circuit 15 judges an occurrence of overcurrent, and further outputs a L-level (low level) signal as a power distribution stop signal to the drive circuit 12, thereby bringing the power distribution through the first power distribution path into a stop to protect the first switching element Q1.

For instance, if an abnormality, such as grounded short circuit, occurs in the load 3, an overcurrent flows through the first switching element Q1, so that the source potential of the same element Q1 becomes substantially 0 V, increasing a differential in potential between the non-inverting input terminal and the inverting input terminal of the Op-Amp 13. Consequently, the electrical current flowing through the transistor Q3 gets increased to cause the voltage proportional to the current detected by the current sensing circuit 14 to exceed the reference voltage Vref. As a result, the overcurrent protective circuit 15 outputs the L-level (low level) signal to the drive circuit 12.

Referring to FIG. 2 again, the first-and-second switching elements 11*a* to 11*d* include heat detecting elements 111*a* to 111*d* for detecting heat generation of the first-and-second switching elements 11*a* to 11*d*, respectively.

In operation, if a heat detection signal outputted from the heat detecting element 111 (111*a* or 111*b* or 111*c* or 111*d*) exceeds a threshold value, then the overheat protective circuit 17 judges an occurrence of overheat, and further outputs a power distribution stop signal to the drive circuit 12, thereby bringing the power distribution through the first power distribution path into a stop to protect the corresponding first-and-second switching element 11 (11*a* or 11*b* or 11*c* or 11*d*) individually.

The current output circuit 16 outputs electrical current, which has been reduced in proportion to the electrical current flowing through the transistor Q3, to the external engine control unit (external ECU) 20 through the I/O unit 7, in the form of a current output signal Iso.

In FIG. 2, the I/O unit 7 provides the four start-up assisting main parts 10*a* to 10*d* with a control command signal Dri transmitted from the external ECU 20, and also provides the ECU 20 with respective current output signals Iso detected by the respective current output circuits 16 thereby to allow the external ECU 20 to generate the above control command signal.

In response to the control command signal Dri inputted from the external ECU 20 through the I/O unit 7 to control the power distribution to each load 3 (3*a*, 3*b*, 3*c* or 3*d*), the drive circuit 12 outputs a drive command signal for driving the first switching element Q1 to the same element Q1. On receipt of the power distribution stop signal from the overcurrent protective circuit 15, additionally, the drive circuit 12 inactivates (or turns off) the first switching element Q1 to stop the power distribution through the first power distribution path.

In a second die pad 22 shown in FIG. 2, there are the four start-up assisting main parts 10*a* to 10*d* juxtaposed to each other and the I/O unit 7. In arrangement, the four first-and-second switching elements 11*a* to 11*d* are also arranged in parallel with each other, corresponding to the four start-up assisting main parts 10*a* to 10*d*. The above-mentioned four first-and-second switching elements 11*a* to 11*d* and the four start-up assisting main parts 10*a* to 10*d* are integrated into one package to constitute a glow control unit (GCU) 5.

Figure 4:
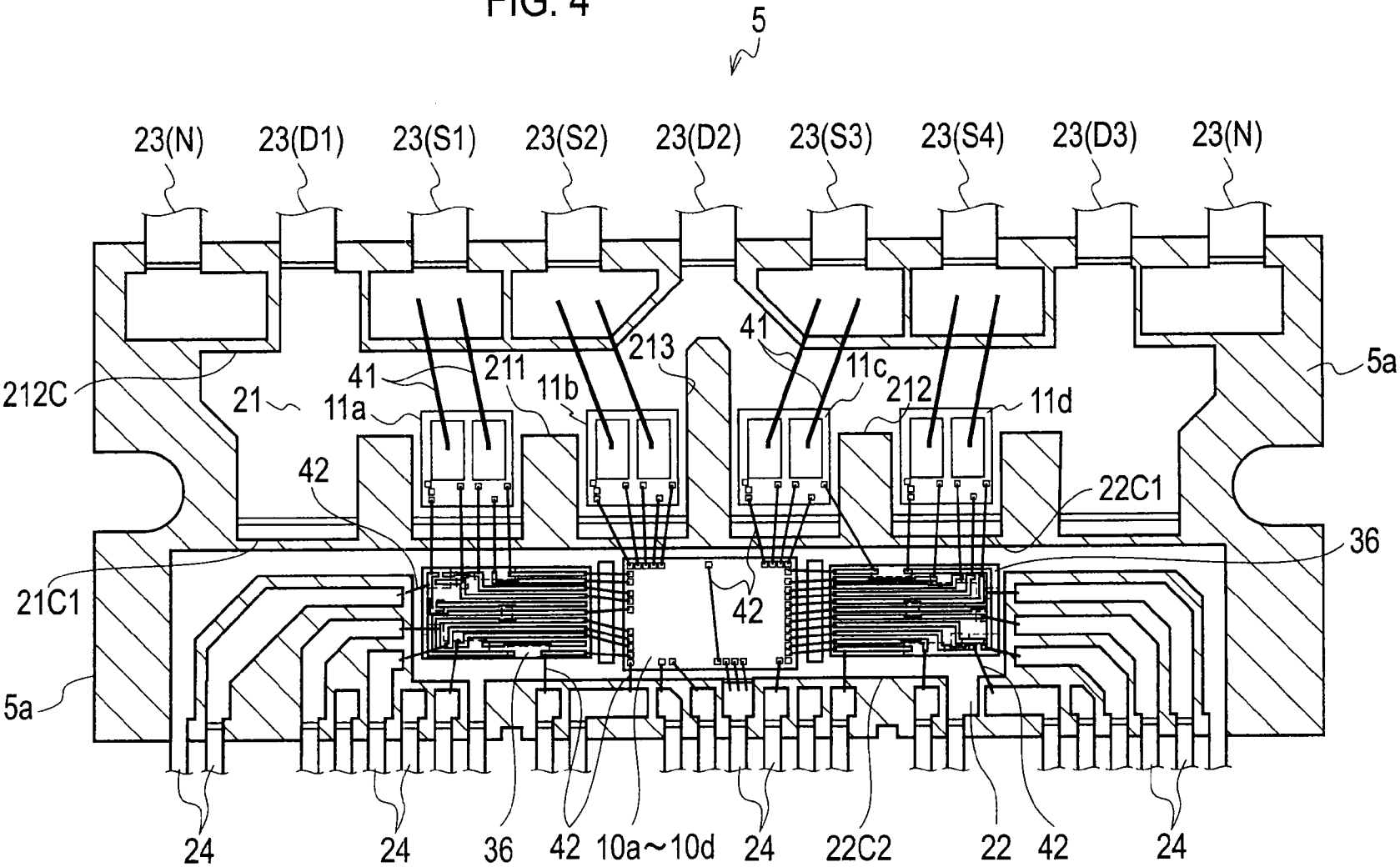
FIG. 4 is a view showing an implementation form where the diesel engine start-up assisting device of FIG. 2 is integrated into one package.

FIG. 4 is a view where the diesel engine start-up assisting device of FIG. 2 is integrated into one package for implementation.

The GCU 5 includes a first die pad 21 (corresponding to a lead frame), the first-and-second switching elements 11*a* to 11*d* arranged on the surface of the first die pad 21, the second die pad 22 having a first lateral face 22C1 distant from a first lateral face 21C1 of the first die pad 21, the start-up assisting main parts 10*a* to 10*d* arranged on the surface of the second die pad 22, a plurality of leads 23 arranged along a second lateral face 21C2 of the first die pad 21, a plurality of leads 24 arranged along a second lateral face 22C2 of the second die pad 22 and a plastic molding body 5*a*.

The first die pad 21 has a first notch part 211 between the first-and-second switching element 11*a* and the first-and-second switching element 11*b*, a second notch part 212 between the first-and-second switching element 11*c* and the first-and-second switching element 11*d* and a third notch part 213 between the first-and-second switching element 11*b* and the first-and-second switching element 11*c*.

The first notch part 211 has a function of reducing mutual temperature interference between the first-and-second switching element 11*a* and the first-and-second switching element 11*b* thereby to stabilize their operating characteristics. The second notch part 212 has a function of reducing mutual temperature interference between the first-and-second switching element 11*c* and the first-and-second switching element 11*d* thereby to stabilize their operating characteristics. Also, the third notch part 213 has a function of reducing mutual temperature interference between the first-and-second switching element 11*b* and the first-and-second switching element 11*c* thereby to stabilize their operating characteristics.

The first die pad 21 is connected to respective back surface poles of the first-and-second switching elements 11*a* to 11*d* electrically. The first-and-second switching elements 11*a* to 11*d* are respectively supplied with principle current (i.e. drain current in this case) through the first die pad 21.

The lead 23(D1), the lead 23(D2) and the lead 23(D3) all arranged along the second lateral 21 C2 of the first die pad 21 are all formed integrally with the first die pad 21. In other words, these leads 23 (D1, D2, D3) are electrically connected to the same pad 21. The leads 23(S1) to 23(S4) are all separated from the second lateral face 21C2 of the first die pad 21. That is, these leads 23(S1) to 23(S4) are also separated from the first die pad 21 electrically. The lead 23(S1) is electrically connected to electrode pads (i.e. source electrode pads) of the first-and-second switching element 11*a* through wires 41. The lead 23(S2) is electrically connected to electrode pads (i.e. source electrode pads) of the first-and-second switching element 11*b* through wires 41. The lead 23(S3) is electrically connected to electrode pads (i.e. source electrode pads) of the first-and-second switching element 11*c* through wires 41. The lead 23(S4) is electrically connected to electrode pads (i.e. source electrode pads) of the first-and-second switching element 11*d* through wires 41.

In the first-and-second switching element 11*a*, its electrode pads (e.g. gate electrode pads in this case) and various sensing electrode pads are electrically connected, on the surface of the second die pad 22, to the start-up assisting main parts 10*a* to

10*d* through an interconnection substrate 36 on the left side of the above parts 10*a* to 10*d* in FIG. 4.

In the first-and-second switching element 11*b*, its electrode pads and various sensing electrode pads are electrically connected to electrode pads of the start-up assisting main parts 10*a* to 10*d* through wires 42 directly.

In the first-and-second switching element 11*c*, its electrode pads and various sensing electrode pads are electrically connected to electrode pads of the start-up assisting main parts 10*a* to 10*d* through wires 42 directly.

In the first-and-second switching element 11*d*, its electrode pads and various sensing electrode pads are electrically connected, on the surface of the second die pad 22, to the start-up assisting main parts 10*a* to 10*d* through an interconnection substrate 36 on the right side of the above parts 10*a* to 10*d* in FIG. 4.

Further, respective electrode pads of the start-up assisting main parts 10*a* to 10*d* are electrically connected to leads 24 arranged along the second lateral face 22C2 of the second die pad 22 through either wires 42 or a combination of wires 42 and the interconnection substrate 36 on each side of the start-up assisting main parts 10*a* to 10*d*.

The plastic molding body 5*a* covers all of the first die pad 21, the first-and-second switching elements 11*a* to 11*d*, the second die pad 22, the start-up assisting main parts 10*a* to 10*d* and respective inner portions of the lead 23, 24 to seal up them in an airtight manner. For example, the plastic molding body 5*a* may be formed by using transfer molding method.

According to the above-mentioned diesel engine start-up assisting device of the first embodiment, since the first die pad 21 is formed, between the adjoining first-and-second switching elements 11*a* and 11*b*; 11*c* and 11*d*; and 11*b* and 11*c*, with the notches 211, 212 and 213, it is possible to restrain the influence of temperature interference between power elements composed of two pairs of first-and-second switching elements 11*a* to 11*d*.

In addition, as the notches 212 to 213 are arranged on the side of the start-up assisting main parts 10*a* to 10*d* of the GCU 5, the same parts 10*a* to 10*d* are capable of radiating heat through the intermediary of the notches 211 to 213, allowing the influence of temperature interference to be restrained.

According to the present invention, since the lead frame is formed, between two pairs of switching elements adjoined to each other, with a notch part, it is possible to restrain the influence of temperature interference between the power elements forming the two pairs of switching elements. Thus, even if the abnormality in heat generation occurs in any one of the power elements, then it is possible to maintain the operation of the device with the remained normal power elements while inactivating only the relevant (abnormal) power element.

In addition, as the drive unit, the current sensing unit, the current output unit and the overcurrent protective unit are adapted so as to radiate heat through the notch part, it is possible to restrain the influence of temperature interference among these units.

Still further, owing to the provision of the overheat protective unit, when it is judged that overheating has occurred, it is possible to protect one pair of switching elements by bringing the power distribution to them to a stop.

For the reasons stated above, the diesel engine start-up assisting device of the present invention can be utilized for vehicles each employing an diesel engine. Finally, it will be understood by those skilled in the art that the foregoing descriptions are nothing but one embodiment of the disclosed diesel engine start-up assisting device and therefore, various changes and modifications may be made within the scope of claims.

What is claimed is:

1. A diesel engine start-up assisting device enabling start-up of a diesel engine when power distribution is applied to at least one of multiple electrical loads, comprising:

a plurality of start-up assisting units, each of which includes:

a first switching element arranged in a first power distribution path extending from a direct-current power source to each of the electrical loads to energize or cut off the first power distribution path, based on a drive command signal inputted to a control terminal of the first switching element;

a drive unit that outputs a drive command signal for driving the first switching element in response to a control command signal inputted from an external control unit to control power distribution to the electrical load;

a second switching element arranged in a second power distribution path to supply a predetermined load with a current from the direct-current power source, the second switching element having its control terminal connected to the first switching element thereby passing an electric current proportional to the first switching element;

a current sensing unit that detects an electrical current flowing through the second power distribution path;

a current output element that outputs an electrical current reduced in proportion to the electrical current flowing through the second power distribution path;

an overcurrent protective unit that judges an occurrence of overcurrent when a current detection signal detected by the current sensing unit exceeds a predetermined value and further outputs a power distribution stop signal to the drive unit, thereby bringing the power distribution through the first power distribution path into a stop to protect the first switching element; and an input-and-output unit that supplies the plurality of start-up assisting units with the control command signal and outputs a plurality of current output signals detected by the plurality of current output units to the external control unit thereby to allow the external control unit to generate the control command signal, wherein the plurality of start-up assisting units and the input-and-output unit are integrated into one package having a lead frame, defining the first switching element and the second switching element as a pair of switching elements, the plurality of first switching elements and the plurality of second switching elements are arranged in parallel with each other on the lead frame, and wherein the lead frame has a notch part formed between two pairs of switching elements adjoined to each other.

2. The diesel engine start-up assisting device of claim 1, wherein the notch part is formed, in the package, on one side thereof to arrange the drive unit, the current sensing unit, the current output unit and the overcurrent protective unit.

3. The diesel engine start-up assisting device of claim 1, wherein both the first switching element and the second switching element comprise MOSFETs.

4. The diesel engine start-up assisting device of claim 1, wherein the pair of switching elements includes a heat detecting unit that detects heat generation of the pair of switching elements, and the start-up assisting unit further includes an overheat protective unit that, if the heat detection signal detected by the heat detecting unit exceeds a threshold value, judges an occurrence of overheat and further outputs a power distribution stop signal to the drive unit to stop the power distribution through the first power distribution path, thereby protecting the pair of switching elements.

5. The diesel engine start-up assisting device of claim 1, wherein the electrical load is a glow plug for the diesel engine.

* * * * *